United States Patent [19]

Nemec

[11] 4,419,088

[45] Dec. 6, 1983

[54] GATE FOLDING APPARATUS

[76] Inventor: David G. Nemec, 13621 Silver Rd., Garfield Hts., Ohio 44125

[21] Appl. No.: 275,285

[22] Filed: Jun. 19, 1981

[51] Int. Cl.[3] ..... B65H 45/18

[52] U.S. Cl. ..... 493/444; 493/457

[58] Field of Search ..... 493/442–445, 493/457, 449–451

[56] References Cited

U.S. PATENT DOCUMENTS

| | | | |
|---|---|---|---|
| 538,609 | 4/1895 | Dexter | 493/445 X |
| 2,106,953 | 2/1938 | Ludewig | 493/444 X |
| 3,901,501 | 8/1975 | Kistner | 493/444 |

*Primary Examiner*—A. J. Heinz

*Attorney, Agent, or Firm*—Pearne, Gordon, Sessions, McCoy, Granger & Tilberry

[57] ABSTRACT

An apparatus for making a gate fold in a prefolded sheet, including a folding table with a central opening, a pair of fold rolls located below the opening and forming a nip, and a vertically movable gate assembly with a blade located parallel to the fold rolls. A sheet in which the gate fold is to be made is conveyed across the table and stopped at a predetermined position over the opening and under the blade. The gate assembly is then lowered until the blade engages the sheet along the desired transverse crease zone and then further lowered to drive the sheet down between the nip formed by the fold rolls to make the gate fold. The gate assembly includes a tuck roll assembly with a pair of tuck rolls parallel to the blade located one on each side and adjacent the lower edge thereof. The tuck roll assembly is movable relative to the gate assembly in a vertical path between a downwardly extended normal position to which it is biased by resilient means, and a retracted position. When the tuck roll assembly travels downward initially with the gate assembly, it reaches a stop position prior to the complete extension of the gate assembly and remains stationary, with the tuck rolls cooperating with the respective fold rolls to guide the sheet during the completion of the folding operation accomplished by the blade.

6 Claims, 17 Drawing Figures

GATE FOLDING APPARATUS

BACKGROUND OF THE INVENTION

This invention relates to the handling and processing of printed paper products, such as brochures and the like, and especially to the automatic folding of such products. More particularly, the invention relates to machines for making a gate fold in a prefolded sheet.

The invention has particular utility with respect to thrice-folded sheets containing four leaves, wherein the two outer leaves are folded inward initially along two parallel fold lines and the resulting folded sheet is again folded along its transverse centerline to form a brochure sheet or the like with four leaves or, in other words, with eight pages. The center fold, which is known in the art as a "gate fold," presents certain problems in automatic folding operations, particularly in view of the two prefolded, inwardly extending end leaves.

Prior art folding machines for making gate folds are best known as "tape and knife" type machines. Normally, these machines are equipped with automatic feeders that feed the sheets one-at-a-time. The sheet rides on endless traveling tapes up to a locator stop, where it is positioned just over a pair of parallel, knurled fold rolls forming a nip. At this point, a folding knife or blade descends from above to drive the sheet down between the nip formed by the knurled fold rolls to cause the sheet to be folded in the middle and drawn downward between the rolls.

The use of such machines has presented certain difficulties in the past, especially those encountered in setting up the apparatus, which often requires as much as half a day. Also, the machines currently available tend to produce random defects such as dog-eared gate folds or roll-back folds.

The apparatus of the present invention, however, overcomes many of the difficulties indicated above, and affords other features and advantages heretofore not obtainable.

SUMMARY OF THE INVENTION

It is among the objects of the invention to form automatically, at a relatively high rate, gate folds in printed sheets having two inwardly extending prefolded leaves or flaps.

Another object is to improve the results achieved in apparatus for automatically making gate folds in prefolded sheets using the "tape and knife" method.

The above objects and advantages are achieved with the improved gate folding apparatus of the invention, which includes as conventional components a folding table with a central opening, a pair of fold rolls located below the opening and forming a nip through which the sheet passes to form the gate fold, and means for transporting the sheets across the table and for stopping the sheets at a predetermined position over the opening.

In accordance with the invention, there is provided a gate assembly located above the opening and movable between a retracted position and a downwardly extended position. The assembly includes a blade adapted to drive a portion of the sheet extended between the fold rolls when the assembly is in its extended position, and a tuck roll assembly, including a pair of tuck rolls extending parallel to the fold rolls. One tuck roll is located on each side of the blade, and both rolls are journaled in bearing blocks located at opposite ends of the tuck roll assembly. The tuck roll assembly is movable relative to the blade between a normal position adjacent the lower end of the blade and a retracted position spaced above the lower end of the blade. The tuck roll assembly is urged by resilient means towards its normal position, and when the tuck rolls reach a predetermined position during downward extension of the gate assembly, further downward movement of the rolls is stopped and the rolls cooperate with the respective fold rolls to guide a portion of the sheet therebetween during continued downward movement of the blade. Thus, the tuck rolls assist in guiding the sheet while the blade engages and drives the sheet downwardly into the nip between the fold rolls to form a gate fold in the sheet.

DESCRIPTION OF THE PREFERRED EMBODIMENT

Figure 1:
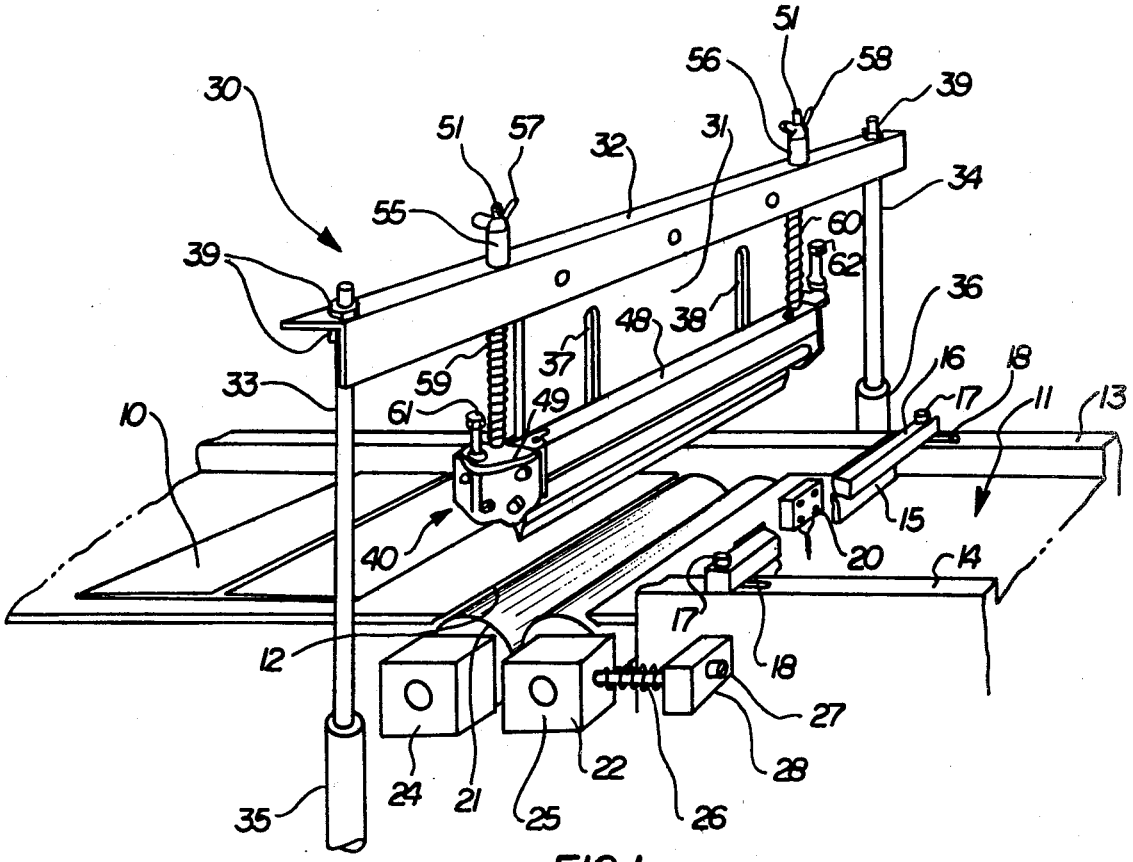
FIG. 1 is a fragmentary, perspective view illustrating a gate folding apparatus embodying the invention.
Figure 2:
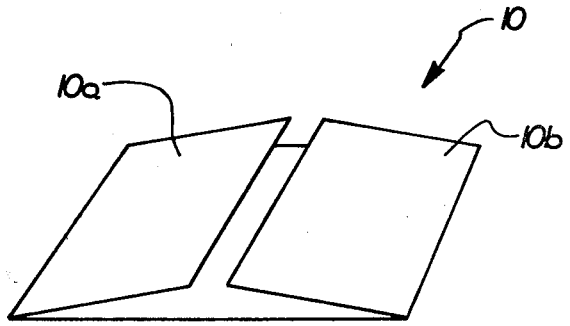
FIG. 2 is a perspective view of a prefolded sheet in which a gate fold is to be formed in order to produce a four-leaf folded product.
Figure 10:
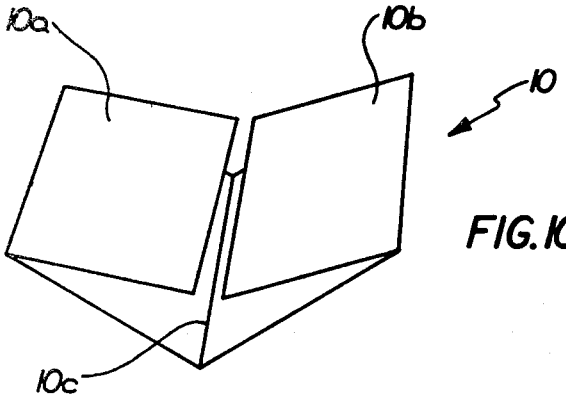
FIG. 10 is a perspective view illustrating the prefolded sheet of FIG. 2 after it has been processed by the apparatus of the invention to produce a gate fold.

Referring more particularly to the drawings, and initially to FIG. 1, there is shown a gate folding apparatus embodying the invention and adapted to form a gate fold in a prefolded sheet 10 having a pair of inwardly folded flaps 10*a* and 10*b*, as shown in FIG. 2. The flaps are normally of equal size and are folded along parallel fold lines so that their inner edges are closely spaced to one another at the transverse centerline of the sheet. The gate fold is preferably formed along the transverse centerline 10*c* to form a four-leaf folded paper product, as shown in FIG. 10.

The apparatus A includes as its principal components a folding table 11, a gate assembly 30, and a tuck roll assembly 40.

The folding table 11 has a central opening 12 extending the full width of the table between parallel edge rails 13 and 14 located on opposite sides of the table. A prefolded sheet 10 that is conveyed along the table by conventional means such as endless belts or "tapes" (not shown) is halted by a stop plate 15 supported by an adjustable support bar 16 that extends across the table between the rails 13 and 14. The opposite ends of the bar 16 are secured to the rails by clamps 17 that extend into slots 18 formed in the rails to permit adjustment of the stop plate 15, depending upon the dimensions of the sheet 10 in which the gate fold is to be formed.

Also mounted on the bar 16 is a limit switch 20 with a sensing arm that signals the operating components of the apparatus when the sheet 10 reaches its predetermined position for folding.

Located below the opening 12 are a pair of parallel fold rolls 21 and 22 which form a nip through which the sheet 10 is driven to form the gate fold. The rolls are journaled at their opposite ends in bearing blocks 24,25 (FIG. 1) and are driven at constant speed in opposite directions by conventional drive means (not shown). The bearing blocks 25 associated with one of the rollers 22 are biased towards the other fixed blocks 24 by springs 26. Screws 27, slidably disposed in fixed blocks 28, adjustably limit the proximity of the rollers 21,22 from a condition of tangent contact to a small parallel spacing as desired.

Figure 3:
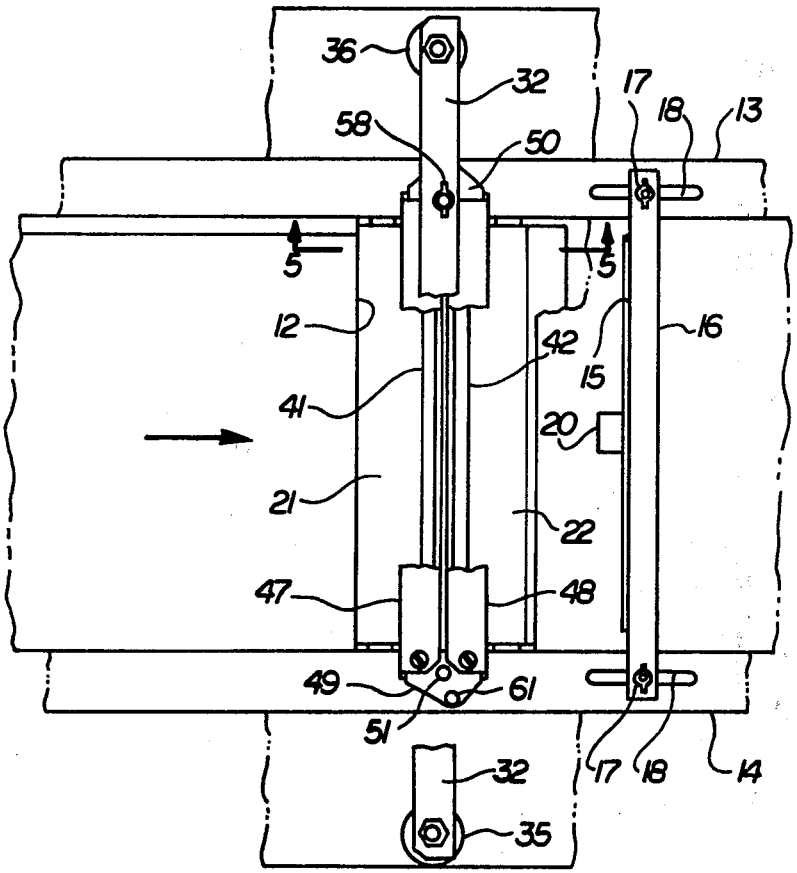
FIG. 3 is a fragmentary plan view of the gate folding apparatus embodying the invention, with parts broken away for the purpose of illustration.
Figure 4:
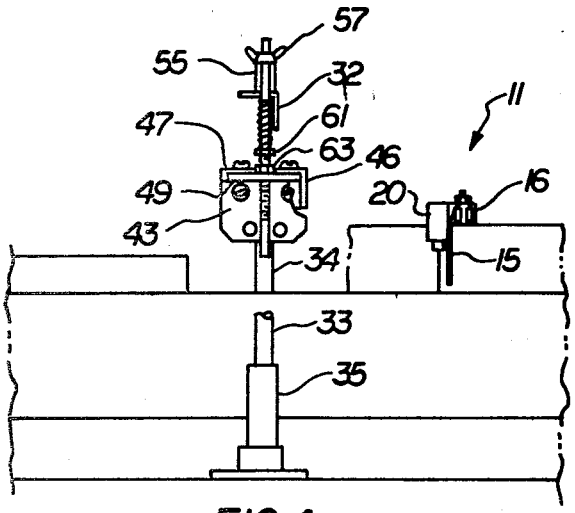
FIG. 4 is a fragmentary side elevation of the gate folding machine, with parts broken away for the purpose of illustration.
Figure 5:
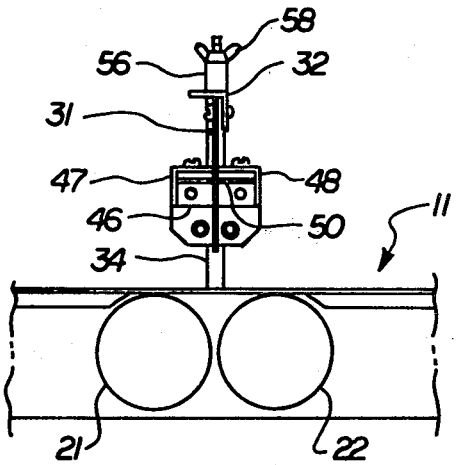
FIG. 5 is a sectional view, taken on the line 5—5 of FIG. 3.

The gate assembly is best shown in FIGS. 3, 4, and 5, and includes a blade or knife 31 positioned immediately above the nip formed by the fold rolls 21 and 22. The blade is supported by an angle bracket 32 extending transversely across the table 11 and supported at its opposite ends by a pair of vertical rods 33 and 34 that are slidably received in respective guide sleeves 35 and 36. Vertical adjustment of the bracket 32 on the rods is provided by means of lock nuts 39 threaded on the rods.

The blade 31 can be provided with two vertical slots 37 and 38 to accommodate an optional guide assembly shown in FIGS. 11 and 12, which will be described in more detail below.

Figure 8A:
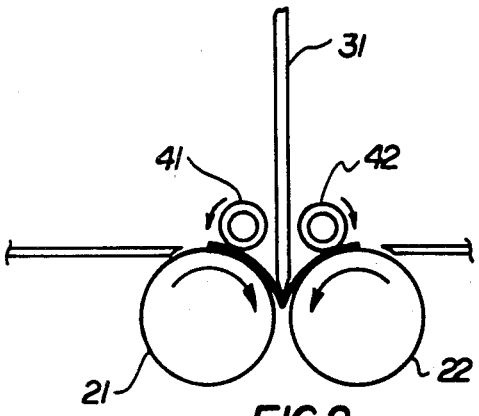
Figure 8B:
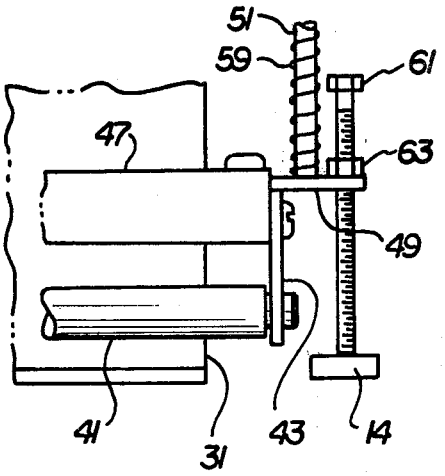

The gate assembly 30 is movable in a vertical path of travel between a raised or a retracted position best shown in FIGS. 1, 4, 5, and 6, and a lowered operating position best shown in FIG. 8. The drive for operating the gate assembly is located below the table and is operatively connected to the rods 33 and 34, as will be readily apparent to those skilled in the art. The components of the drive are conventional and are not shown or further described herein.

It will be noted that the blade 31 is located in alignment with the zone between the fold rolls 21 and 22, the fold rolls forming a nip into which the sheet 10 is driven by the blade 31 so as to draw the sheet 10 between the rolls and form the gate fold. The rolls 21 and 22 are driven for rotation in opposite directions and are geared to one another to assure that the speeds are synchronized. The drive for the rolls is conventional, and here again is not shown or further described.

The tuck roll assembly 40 is operatively connected to the gate assembly 30 and includes a pair of tuck rolls 41 and 42 located on opposite sides of the blade 31 and adjacent the lower end thereof. The rolls 41 and 42 are journaled at their opposite ends in bearing blocks 43 and 44 that are secured by machine screws (FIG. 7) to end brackets 45 and 46, respectively. The end brackets 45 and 46 are connected to one another by means of transversely extending angle bars 47 and 48 located on opposite sides of the blade 31.

Mounted between the brackets 45,46 and the respective ends of the angle bars 47 and 48 are mounting plates 49 and 50 positioned at each end of the tuck roll assembly 40 and spaced from the blade 31, as best shown in FIG. 3. The tuck roll assembly is supported at its opposite ends by threaded rods 51 and 52, the lower ends of which are received in tapped holes 53 and 54 in the mounting plates 49 and 50, and which extend upwardly through openings in the bracket 32 and through spacer sleeves 55 and 56. The upper ends of the rods 51 and 52 have wing nuts 57 threaded thereon, which engage the top of the sleeves 55 and 56, respectively, to support the gate assembly 30 which is suspended therefrom.

It will be noted that the tuck roll assembly 40 is not positively secured to the gate assembly, but is capable of vertical movement relative thereto, as will be apparent form FIGS. 6 through 9. The tuck roll assembly, however, is biased toward the position shown in FIGS. 4, 5, and 6 by means of helical springs 59 and 60 that surround the respective threaded rods 51 and 52 and which bear between the respective mounting plates 49 and 50 and the bottom of the bracket 32. Accordingly, the tuck roll assembly 40 will move vertically with the gate assembly until such movement is interrupted, after which the tuck roll assembly may be halted, although the gate assembly continues to move downwardly, with resultant compression of the helical springs 59 and 60.

The normal position of the tuck roll assembly 40 relative to the gate assembly may be adjusted by means of the wing nuts 51 and 52. The compression of the helical springs 59 and 60 may be increased or decreased by using sleeves 55 and 56 of different length. The lower limit position of the tuck roll assembly 40 is determined by stop bolts 61 and 62 which are threaded through threaded openings in the plates 49 and 50, respectively, and which are adapted to engage the opposite edge rails 13 and 14, respectively, of the table 11 when the desired downward travel of the tuck roll assembly is accomplished. The bolts 61 and 62 are securely fixed in the desired position, using lock nuts 63 and 64, respectively.

Figure 12:
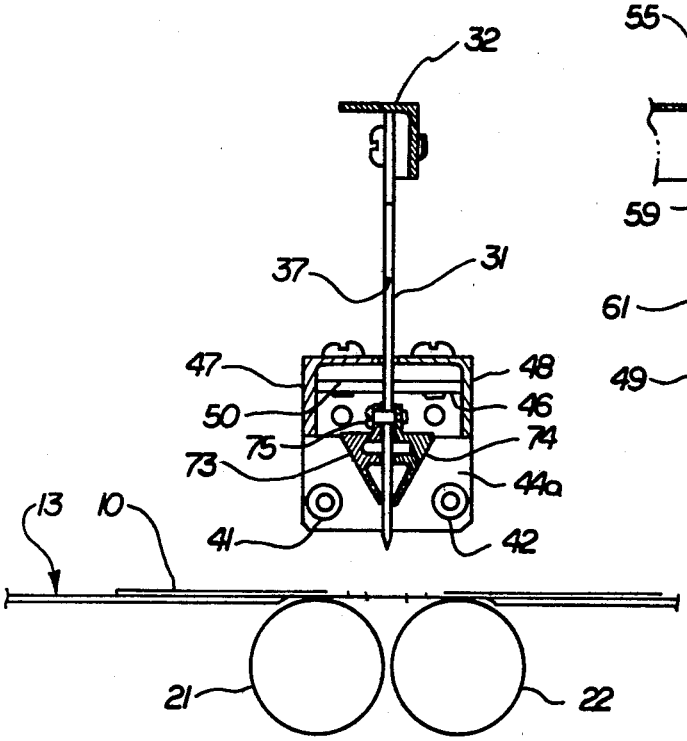
FIG. 12. is a fragmentary, sectional view taken on the line 12—12 of FIG. 11.
Figure 11:
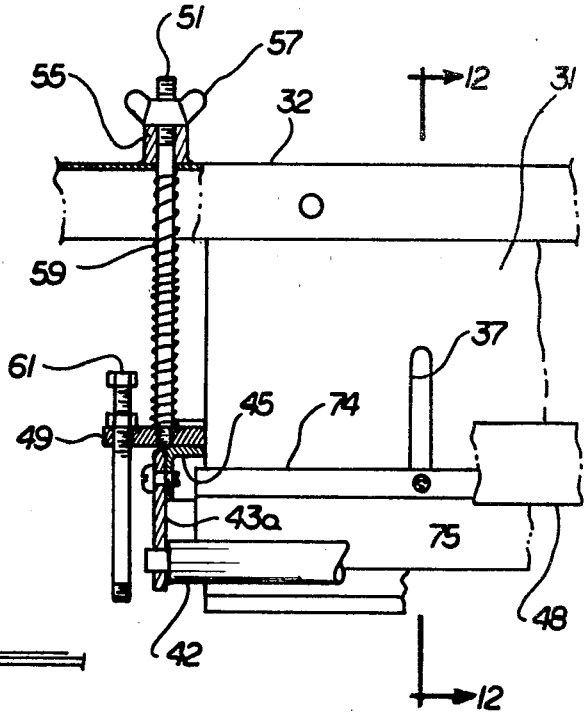
FIG. 11 is a fragmentary, elevational view on an enlarged scale, illustrating a modified form of gate folding apparatus embodying the invention.
Figure 13:
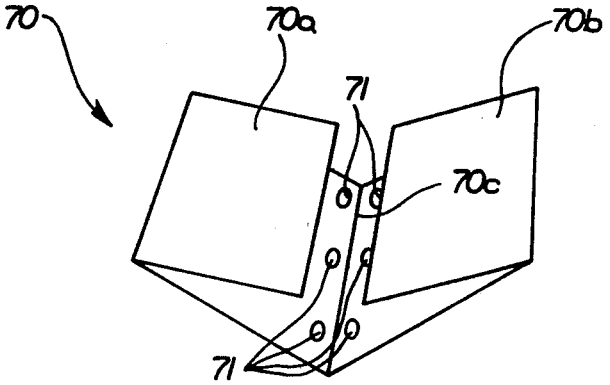
FIG. 13 is a perspective view similar to FIG. 10, illustrating a gate fold formed by the apparatus of the invention, wherein the resulting folded product has binder holes punched in the vicinity of the gate fold.

FIGS. 11 and 12 illustrate an alternate form of gate folding apparatus embodying the invention, wherein special provision is made to accommodate a different type of prefolded sheet 70 (FIG. 13), with the ends of the end flaps or leaves 70*a* and 70*b* spaced sufficiently from one another to leave room for punched holes 71 on opposite sides of the gate fold line 70*c*. The holes (usually three on each side) are spaced to permit anchoring of the resulting folded paper product 70 in a conventional three-ring binder, for example.

Because the inner ends of the leaves 70*a* and 70*b* are initially located at a relatively wide spacing from one another, it is desirable that the tuck rolls 41 and 42 also be more widely spaced in order to assure proper engagement with the end leaves. In order to accomplish this, the bearing blocks 43 and 44 are replaced with the alternate blocks 43*a* and 44*a* to obtain the spacing shown in FIGS. 11 and 12.

To provide additional guiding of the end leaves 70*a* and 70*b*, the gate assembly 30 is provided with a pair of guide members 73 and 74 located on opposite sides of the blade 31. The guide members define wedge-shaped faces angularly disposed relative to the blade 31 and are connected to one another by fasteners 75 that extend through the slots 37,38 in the blade. The guide members are not clamped to the blade 31, but are loosely connected thereto to permit vertical movement through a range limited only by the slots 37.

The guide members assure that the end leaves 70*a* and 70*b* are smoothly driven downwardly toward the nip between the fold rolls 21 and 22.

OPERATION

Figure 6A:
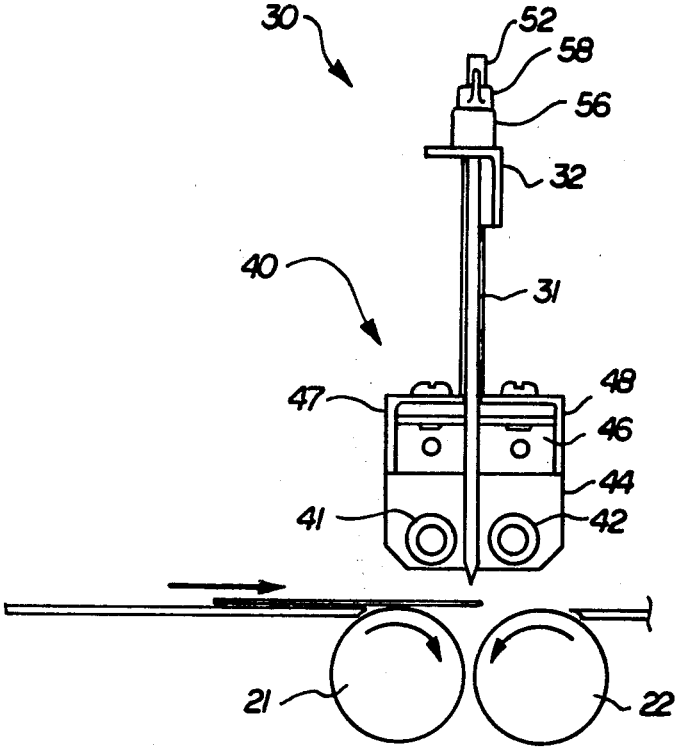
FIGS. 6, 7, 8, and 9 are sequential views illustrating the operation of the gate folding apparatus of the invention, each view (6, 7, 8, and 9) including a sectional view (e.g., FIG. 6*a*) similar to FIG. 5, but on an enlarged scale, and a fragmentary elevation (e.g., FIG. 6*b*) taken from the left as viewed in FIG. 4, but on an enlarged scale.
Figure 6B:
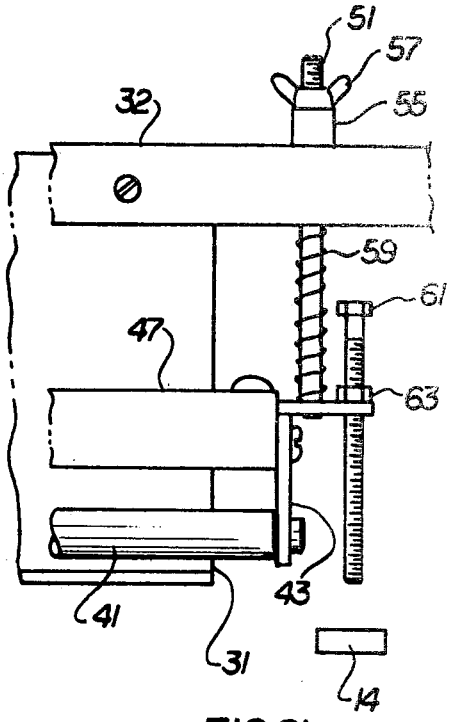

The operation of the gate fold apparatus of the invention is best illustrated in FIGS. 6 through 9, which show sequentially the movements of the apparatus incident to the forming of a gate fold in the prefolded sheet 10. FIG. 6 shows a sheet being transported by conventional means, such as endless belts or tapes (not shown) located on the table 11. The sheet 10 travels from left to right, as illustrated by the arrow in FIG. 6, until the leading edge of the sheet engages the stop plate 15 and at the same time trips the limit switch 20. The stop plate 15 has been preadjusted so that the sheet stops over the opening 12 with the desired fold line 10*a* located immediately below the blade 31 and above the nip in the fold rolls 21 and 22.

Figure 7A:
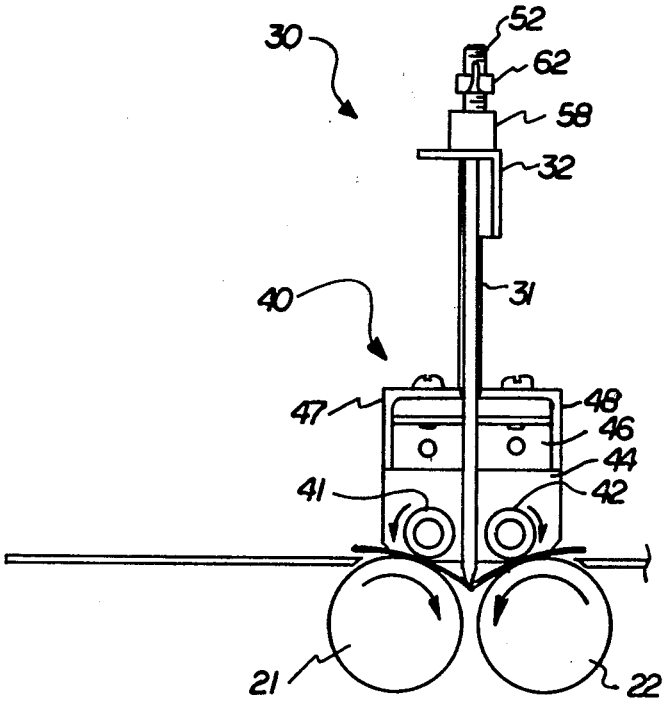
Figure 7B:
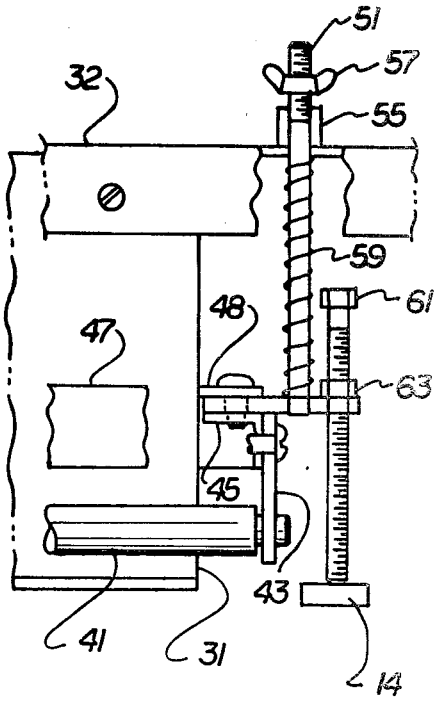

When the sheet 10 is in this desired position, the limit switch 20 will have activated a gate assembly operating mechanism to initiate the downward travel of the gate assembly 30. Accordingly, the blade 31 engages the sheet 10 along the desired fold line, as illustrated in FIG. 7, and presses the sheet downwardly toward the nip between the rolls 21 and 22. At the same time, the tuck roll assembly 40, which is carried along with the gate assembly, is also lowered to maintain control of and guide the associated edges of the leaves 10*a*,10*b* overlying the desired fold line. The tuck roll assembly 40 continues to move to a position illustrated in FIG. 7, whereat the ends of the stop bolts 61 and 62 engage the respective edge rails 13 and 14 to block any further lowering of the tuck roll assembly. At this limit position, the tuck rolls 4 and 42 are closely spaced from the respective fold rolls 21 and 22, and guide the resulting movement of the sheet accordingly as the opposite sides of the prefolded sheet pass therebetween.

The fold rolls 21 and 22 thereupon are driven in opposite directions shown by the arrows in FIGS. 7 and 8 to urge the fold line portion of the sheet therebetween.

As shown in FIG. 8, the blade 31 has pressed the fold line zone of the sheet into the nip between the rolls 21 and 22, while the resulting movement of the opposite sides of the sheet between the respective tuck rolls 41 and 42 and fold rolls 21 and 22 continues, so that the fold begins to form along the desired fold line 10*c*.

Figure 9A:
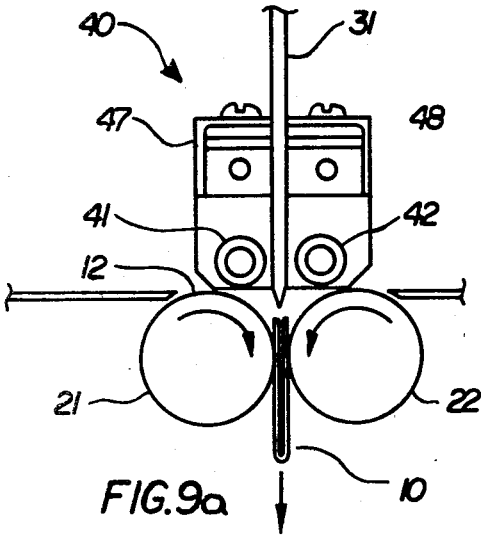
Figure 9B:
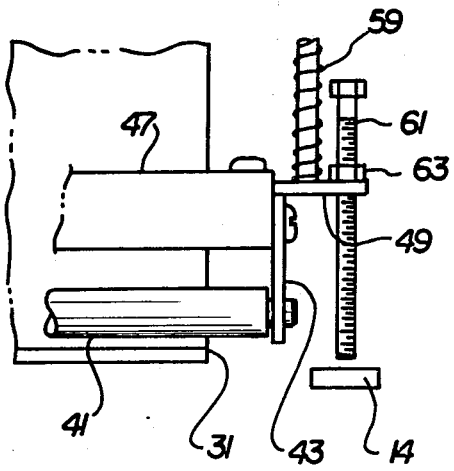

FIG. 9 illustrates the final phase of the folding operation, wherein the sheet 10 is drawn downwardly between the rolls, with the gate fold formed therein to produce the gate-folded paper product illustrated in FIG. 10. Also, FIG. 9 illustrates the initial retraction movement of the gate assembly 30, along with the tuck roll assembly 40, the upward movement continuing back to the initial position shown in FIG. 6, preparatory to performing a gate folding operation on another sheet 10.

While the invention has been shown and described with respect to a specific embodiment thereof, this is intended for the purpose of illustration rather than limitation, and other variations and modifications of the specific apparatus herein shown and described will be apparent to those skilled in the art, all within the intended spirit and scope of the invention. Accordingly, the patent is not to be limited in scope and effect to the specific form herein shown and described, nor in any other way that is inconsistent with the extent to which the progress in the art has been advanced by the invention.

What is claimed is:

1. In apparatus for making a gate fold in a sheet having two inwardly extending prefolded flaps forming two folded end edges, said apparatus including a folding table defining a central opening, means for transporting said sheet across said table, means for stopping said sheet at a predetermined position on said table with a central portion of said sheet spanning said opening, and a pair of fold rolls below said opening adapted to pass said sheet therebetween to form said gate fold, the improvement which comprises:

a gate assembly located above said opening and movable between a retracted position and a downwardly extended position, said assembly including a blade adapted to drive a portion of said sheet between said rollers when said assembly is in its extended position, said blade having a lower end, and a tuck roll assembly including a pair of tuck rolls extending parallel to said fold rolls, one tuck roll being located on each side of said blade and a pair of bearing blocks spaced at opposite ends of said assembly, said tuck rolls being journaled at each end in a respective bearing block, means for supporting and guiding the rolls of said tuck roll assembly for vertical movement relative to said blade between a normal position adjacent and above the lower end of said blade and a retracted position spaced above the normal position, and means urging said tuck roll assembly toward said normal position, each of said tuck rolls being adapted to cooperate with a respective fold roll to movably guide a portion of said sheet passing therebetween, whereby when said prefolded sheet reaches a predetermined position on said table said gate assembly is lowered and the lower end of said blade engages a central zone across said sheet and drives it downwardly, said tuck rolls engaging said sheet adjacent each respective fold roll to grip respective portions of said sheet to control said sheet as the lower end of said blade drives said central zone between said fold rolls to form a gate fold in said sheet.

2. Apparatus as defined in claim 1, wherein said means supporting and guiding said tuck roll assembly comprises at least two vertical suspension elements connected at their lower ends to said tuck roll assembly and suspended at their upper ends from said gate assembly.

3. Apparatus as defined in claim 2, wherein said suspension elements are threaded rods, the lower ends thereof being threadedly connected to said bearing blocks respectively and the upper ends thereof slidably extending through said gate assembly, and including adjustable threaded means connected to the upper ends of said threaded rods and which are adapted to rest against said gate assembly to support said tuck rolls at an adjustable position relative to said blade and to permit upward movement of said tuck rolls relative to said blade.

4. Apparatus as defined in claim 1, 2, or 3, including means carried by said tuck roll assembly and cooperable with said folding table for limiting the downward movement of said tuck rolls during downward movement of said blade so that said tuck rolls are stopped at a predetermined position closely spaced to the respective fold rolls while said blade continues downward to complete the gate folding process.

5. Apparatus as defined in claim 1, 2, or 3, wherein said means urging said tuck roll assembly toward said normal position comprises flexed spring means bearing upwardly against said gate assembly and downwardly against said tuck roll assembly.

6. Apparatus as defined in claim 1, 2, or 3, including means operatively connected to said blade on opposite sides thereof and spaced above the lower edge thereof for engaging and guiding said sheet as said sheet is driven down between said fold rolls by said blade.

* * * * *